US006994338B2

(12) United States Patent
Lehmann

(10) Patent No.: US 6,994,338 B2
(45) Date of Patent: Feb. 7, 2006

(54) METHOD OF AND APPARATUS FOR PIVOTABLY COUPLING STACKED SHEET-LIKE COMMODITIES WITH EACH OTHER

(75) Inventor: Hartmut Lehmann, Nürtingen (DE)

(73) Assignee: Kugler-Womako GmbH, Nurtingen (DE)

( * ) Notice: Subject to any disclaimer, the term of this patent is extended or adjusted under 35 U.S.C. 154(b) by 212 days.

(21) Appl. No.: 10/400,068

(22) Filed: Mar. 27, 2003

(65) Prior Publication Data

US 2004/0013496 A1 Jan. 22, 2004

(30) Foreign Application Priority Data

Mar. 28, 2002 (DE) ..... 102 14 342

(51) Int. Cl.
*B42B 9/00* (2006.01)

(52) U.S. Cl. ..... 270/58.08; 412/38; 412/42

(58) Field of Classification Search ..... 270/58.07, 270/58.08; 412/38, 39, 40, 42, 43
See application file for complete search history.

(56) References Cited

U.S. PATENT DOCUMENTS

| | | | | |
|---|---|---|---|---|
| 3,334,918 A | * | 8/1967 | Pigna et al. | 281/27.2 |
| 3,451,081 A | * | 6/1969 | Liouville | 412/39 |
| 3,883,916 A | * | 5/1975 | Adams et al. | 412/39 |
| 3,889,309 A | * | 6/1975 | Adams et al. | 412/39 |
| 4,031,585 A | * | 6/1977 | Adams | 412/39 |
| 4,457,655 A | * | 7/1984 | Fabrig | 412/7 |
| 4,558,981 A | * | 12/1985 | Fabrig | 412/7 |
| 4,610,590 A | * | 9/1986 | Pigna | 412/11 |
| 5,707,195 A | * | 1/1998 | Scholz | 412/39 |
| 6,062,792 A | * | 5/2000 | Garrity | 412/39 |
| 6,409,447 B2 | * | 6/2002 | Malmros | 412/40 |

FOREIGN PATENT DOCUMENTS

| | | |
|---|---|---|
| DE | 1 611 018 | 9/1970 |
| DE | 2 403 154 | 8/1974 |
| DE | 31 41 686 | 6/1982 |
| DE | 31 41 686 A | 6/1982 |
| DE | 0 95 244 | 11/1983 |
| DE | 195 39 213 A | 4/1997 |

* cited by examiner

*Primary Examiner*—Patrick Mackey
(74) *Attorney, Agent, or Firm*—Venable LLP; Robert Kinberg; Catherine M. Voorhees

(57) ABSTRACT

Deformable metallic or plastic connectors of the type having an elongated bridge carrying two mirror symmetrical rows of substantially C-shaped prongs can be assembled with successive stacks of overlapping sheets, wherein the spine of each stack is provided with a row of straight or arcuate holes, by causing the connector at an inserting station to move along an arcuate path extending transversely of the bridge and having a curvature corresponding to or approximating that of the prongs in one of the rows or that of the arcuate holes. This results in the introduction of one of the rows of prongs into the holes. The prongs of at least one of the two rows are thereupon deformed so that the tips of the prongs of one row abut or at least slightly overlap the tips of the prongs of the other row; this prevents accidental separation of the connector from the stack.

18 Claims, 8 Drawing Sheets

38
110
112
115
116
118
120
122
124
126
29
29a
29b
29c
46
42
60
60a
58
82
72
72a
72b
76
74
78
80
56a
64
100
102
98
94
96
94a
92
90
68
56
56b
66
94b
54a
53
54
51a
52b
52a
52
51
50
36

METHOD OF AND APPARATUS FOR PIVOTABLY COUPLING STACKED SHEET-LIKE COMMODITIES WITH EACH OTHER

CROSS-REFERENCE TO RELATED CASES

The present application claims the priority of the commonly owned copending German patent application Serial No. 102 14 342.0 filed Mar. 28, 2002. The disclosure of the aforementioned German patent application, as well as those of each US and foreign patent and patent application identified in the specification of the present application are incorporated herein by reference.

BACKGROUND OF THE INVENTION

This invention relates to improvements in methods of and in apparatus for pivotally coupling stacked sheet-like commodities with each other. For example, the method and the apparatus of the present invention can be utilized to convert stacks of paper sheets, plastic foils, cardboard panels, metallic foils and/or the like (hereinafter called sheets for short) into memo pads, other types of pads, calendars, advertising brochures or the like (hereinafter called commodities) by resorting to elongated connectors having rows of preferably arcuate tines or prongs which can be introduced into the rows of perforations provided in the individual sheets at the spines of stacks of overlapping sheets.

As a rule, or at least in many instances, the connectors which are utilized to pivotably connect the sheets of a stack of overlapping sheets comprise (a) coil springs or (b) elongated connectors having a first row of substantially C-shaped tines or prongs and a second row of tines or prongs which are exact or at least substantial mirror images of the tines or prongs of the first row, wherein the tines or prongs of the first and second rows are bend and closed together when being received in corresponding perforations of a stack of overlapping sheets. Each hole consists of a plurality of at least substantially registering perforations provided in each of the overlapping sheets. The present invention relates to a method of and to an apparatus for pivotally connecting overlapping sheets of stacks by resorting to connectors of the type described at (b) hereinbefore. The prongs of the substantially omega-shaped connectors can consist of a metallic or a plastic material.

Apparatus for converting the aforementioned omega-shaped connectors and stacks of sheets into pads or analogous commodities normally or often form part of semi-automatic or fully automated production lines which employ facilities for converting large panes or webs or strips of paper or the like into stacks of overlapping sheets, for providing the sheets with perforations preparatory to, during or subsequent to stacking, for providing (if necessary) some or all of the sheets with printed matter and/or other form(s) of information, and for pivotably coupling the sheets of each stack to each other by substantially omega-shaped connectors. Accurate overlapping of sheets in each stack prior to the application of connectors is not only desirable but actually critical because this facilitates accurate, predictable and rapid introduction of tines or prongs into the respective holes and the conversion of stacks into pads or analogous commodities of satisfactory utility and eye-pleasing appearance. When the insertion of the tines or prongs (hereinafter called prongs) into the respective holes in the spine of a stack of overlapping sheets is completed, each prong of one row cooperates with one prong of the other row to form therewith a substantially O-shaped composite prong or eyelet which allows each individual sheet or a group of two or more neighboring sheets of the finished commodity to pivot relative to the other sheet(s) of the stack. Prior to the deformation of its prongs, each connector resembles an elongated worm-like larva (such as a caterpillar) having two mirror symmetrical sets of legs (prongs) each of which can resemble a part of a circle (i.e., a letter C) extending along an arc of approximately 180°. The connectors are mass-produced in a machine which turns out so-called "open" connectors, i.e., each of the prongs which form the two sets of prongs has a first end portion of one piece with the elongated bridge and a second end portion. The second end portions of prongs in one of the rows are spaced apart from the second end portions of prongs in the other row. When the connector is properly inserted into a stack and its prongs are properly deformed, the second end portion of each prong of one of the rows can abut or overlie the second end portion of the corresponding prong of the other row, and such second end portions of each pair of C-shaped prongs can be confined in the respective hole in the spine of the corresponding stack.

The manner in which the shapes of holes in the spines of stacked sheets can be altered prior to insertion of portions of connectors is disclosed in commonly owned copending U.S. patent application Ser. No. 10/400,065 filed Mar. 27, 2003 by Ferdinand Fuchs for "METHOD OF AND APPARATUS FOR GATHERING STACKS OF SHEETS AND THE LIKE".

Apparatus for pivotally connecting stacked sheets to each other by spiral-shaped connectors is disclosed in commonly owned copending patent application Ser. No. 10/396,705 filed Mar. 26, 2003 by Ferdinand Fuchs for "APPARATUS FOR COUPLING STACKED SHEETS".

OBJECTS OF THE INVENTION

An object of the present invention is to provide a method of making pads of overlapping sheets or analogous commodities wherein the substantially omega-shaped connectors with two rows of substantially C-shaped prongs can be manipulated in a novel and improved way prior to, during and/or subsequent to insertion into the holes in the spine of a stack of overlapping sheets.

Another object of this invention is to provide a method which renders it possible to manipulate the connectors in a highly predictable manner prior to, during and upon insertion of their prongs into the holes provided in the spines of stacks of overlapping sheets.

A further object of the instant invention is to provide a method which renders it possible to insert the prongs of the connectors into the holes in the spines of stacks of overlapping sheets in such a way that the prongs need not touch (and possibly displace and/or damage) the sheets during insertion into the holes.

An additional object of the invention is to provide a novel and improved apparatus for the practice of the above outlined method.

Still another object of the present invention is to provide the apparatus with novel and improved means for supporting and manipulating the connectors for stacked or stapled sheets prior to, during and subsequent to introduction of the prongs of connectors into the holes of stacks.

A further object of this invention is to provide the apparatus with novel and improved means for making, assembling and otherwise manipulating the stacks of overlapping sheets on their way toward the station where the stacked sheets of successive stacks or successive groups of stacks are pivotably connected to each other.

Another object of the invention is to provide the above outlined apparatus with novel and improved means for positioning, moving, arresting and/or otherwise manipulating the parts which come in actual contact with the stacks of sheets and/or with the connectors which pivotably couple the sheets of successive discrete stacks or successive groups of two or more stacks to each other.

An additional object of the invention is to provide an apparatus of the above outlined character which van be utilized in conjunction with conventional or with novel sheet- and stack-manipulating devices.

SUMMARY OF THE INVENTION

One feature of the present invention resides in the provision of an apparatus which serves to apply to stacks of overlapping sheets of paper or the like connectors of the type having an elongated bridge or holder which carries two at least substantially mirror symmetrical rows of curved (e.g., C-shaped) prongs receivable in holes provided therefor in one of several marginal portions (namely in the so-called spines) of the stacks. The improved apparatus comprises means for positioning successive stacks of a series of stacks at an inserting station, means for conveying successive connectors of a series of connectors to the inserting station in positions such that the prongs of at least one of the two rows of prongs forming part of the connector are aligned with the holes of the stacks at the inserting station, and means for introducing at least the prongs of the at least one row into the holes of the stack at the inserting station. The introducing means includes means for moving the connector which is located at the inserting station along an arcuate path extending transversely of the bridge of such connector and at least approximating at least one of (a) the curvature of the prongs in the at least one row and (b) the shapes of the holes in the stack at the inserting station.

The connectors can be of the type wherein the prongs of each of the two rows have shapes at least approximating part circular shapes. In an apparatus which manipulates such connectors, the arcuate path can have a center of curvature on a line including the centers of curvature of the one row of prongs.

The connectors can be made, at least in part, of a bendable metallic material (e.g., wire).

The moving means of the improved apparatus can include means for moving the connector at the inserting station along the aforementioned path until the prongs of the at least one row of prongs extend at least substantially through the respective (aligned) holes of the stack at the inserting station.

The connectors can be of the type wherein the prongs of each row have first ends of one piece with the bridge and second ends, with the second ends of one row of prongs spaced apart from the second ends of prongs in the other row. Such apparatus can further comprise means for deforming the prongs of at least one row of prongs of the connector to move the second ends of the prongs of the at least one row close to the second ends of prongs of the other row.

The improved apparatus can further comprise means for removing stacks from the inserting station and means for clamping the connectors to the respective stacks upon removal of stacks from the inserting station.

The conveying means can include means for supplying successive connectors of the series of connectors into the range of the clamping means by moving the connectors lengthwise of the respective bridges. Such conveying means can be arranged to advance successive connectors of the series along a second path, and the clamping means of such apparatus can include means for moving successive connectors of the series at least substantially transversely of the second path. The just mentioned clamping means can include a first section and a second section which is movable relative to the first section.

Another feature of the present invention resides in the provision of a method of applying to stacks of overlapping sheets deformable connectors of the type having an elongated bridge carrying two at least substantially mirror symmetrical rows of curved prongs receivable in holes provided in one of several marginal portions of the stacks, namely in the so-called spine. The prongs of the aforementioned rows have first ends affixed to the bridge and second ends with the second ends of prongs in one of the rows spaced apart from the second ends of prongs in the other row prior to the application of connectors to the stacks. The improved method comprises the steps of positioning successive stacks of a series of stacks at an inserting station, conveying successive connectors of a series of connectors to the inserting station and positioning a connector arriving at the inserting station in such a way that the second ends of prongs of the one row are aligned with the holes of the stack at the inserting station, and introducing the prongs of the one row into the holes of the stack at the inserting station. The introducing step includes moving the connector at the inserting station to advance the prongs of the one row along arcuate paths having curvatures at least approximating at least one of (a) the curvatures of the moving prongs and (b) the shapes of holes in the stack at the inserting station.

If the prongs have part circular shapes, the moving step can include turning the connector at the inserting station about an axis which includes the centers of curvature of one of the rows of prongs forming part of the connector at the inserting station. The just mentioned turning step can include holding the connector at the inserting station by a mobile clamping device.

The conveying step can include advancing successive connectors of the series of connectors along a second path which extends lengthwise of the bridges of the advancing connectors. Such conveying step can further include moving successive connectors of the series of connectors transversely of their bridges upon arrival at the inserting station and prior to the introducing step.

The improved method can further comprise the step of deforming successive connectors upon completion of the introducing step to thus prevent accidental or even intentional withdrawal of prongs in the one row from the respective holes. Such deforming step can include moving the second ends of the rows of prongs of the connector at the inserting station toward each other. The just described method can further comprise the step of removing the stacks from the inserting station upon completion of the introducing or deforming step.

The connectors are or can be deformable (such as bendable) and, to this end, can consist at least in part of a suitable metallic or plastic material. The method of manipulating such connectors can further comprise the steps of assembling sheets into stacks prior to the positioning step and perforating the sheets prior to the assembling step in such a way that the perforations of stacked sheets are in at least substantial alignment with each other and form the aforementioned holes.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of several presently preferred specific embodiments with reference to the accompanying drawing.

DESCRIPTION OF PREFERRED EMBODIMENTS

Figure 1A:
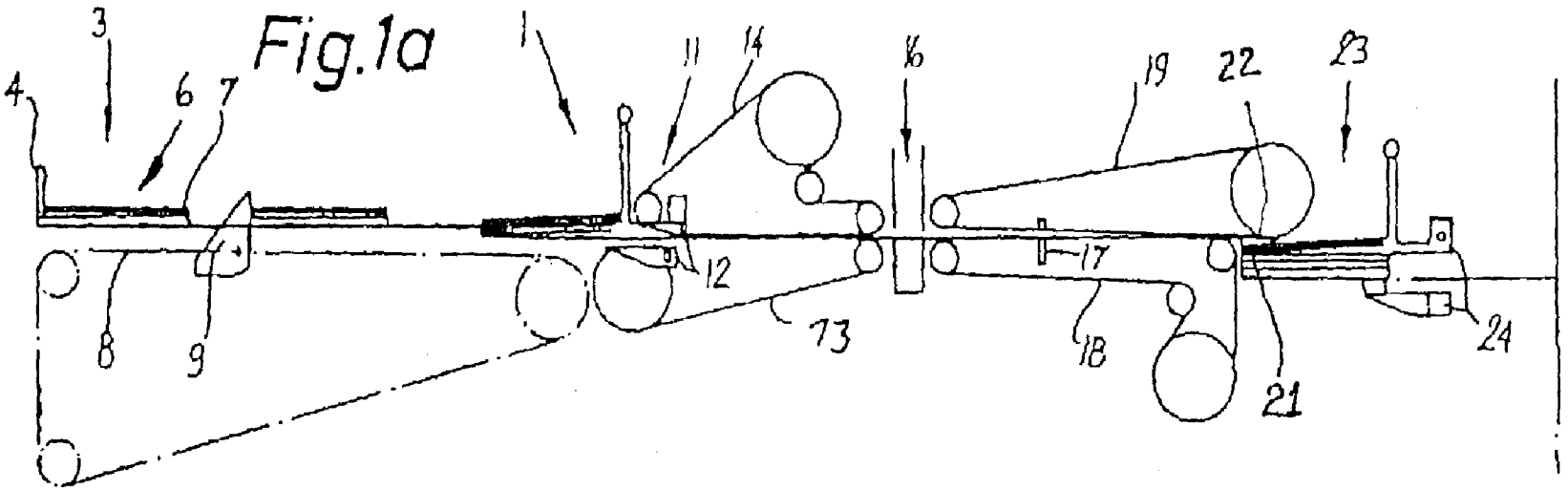
FIG. 1*a* is a schematic side elevational view of a portion of an arrangement which serves to assemble stacks of sheets adapted to be pivotably connected to each other in apparatus embodying one presently preferred form of the invention.

FIG. 1*a* shows a straight first section 1 of an arrangement (such as a production line) which serves to assemble stacks 29 (see FIG. 1*b*) of overlapping sheets 29*c*, to provide one marginal portion (the so-called spine) 29*b* of each stack 29 with a row of holes 29*a* (see FIGS. 2 to 7), and to pivotably connect the sheets 29*c* of each stack 29 to each other by substantially omega-shaped elongated connectors 42 (see FIGS. 2 to 7) each having a first row of substantially C-shaped tines or prongs 42*a* and a second row of tines or prongs 42*b* which are exact or at least substantial mirror images of the prongs 42*a*.

The section 1 of FIG. 1*a* includes a receiving station 3 where successive piles 6 of overlapping large sheets or panes 7 are delivered (e.g., by hand) into the range of successive entraining elements or pushers 9 (only one shown) forming part of an endless belt, band or chain conveyor 8. Each pile 6 is placed against a stationary aligning stop 4, and the oncoming pusher 9 engages and entrains such pile into the range of a dividing or splitting unit 11. The latter includes tongs 12 or other suitable means for splitting up each pile 6 into two or more smaller (thinner) piles which are entrained by the horizontal reaches of two endless belt, band or chain conveyors 13, 14 serving to advance successive smaller piles into the range of a perforating unit 16.

The front face of a smaller pile which is properly positioned relative to the perforating unit 16 abuts a retractible stop 17 which ensures that the unit 16 provides the trailing edges 21 of individual sheets 7 of each smaller pile with perforations 22 forming a straight row extending at right angles to the plane of FIG. 1*a*.

When the making of a row of perforations 22 by the unit 16 is completed, the stop 17 is temporarily retracted so that the smaller pile can be advanced by two endless belt, band or chain conveyors 18, 19 to a gathering station 23 wherein the smaller piles are reassembled into piles 6 each containing the same number of large sheets or panes 7 as the piles which are being entrained by the pushers 9 of the conveyor 8. The means for withdrawing successive reassembled piles 6 from the gathering station 23 includes adjustable tongs 24 which delivers the reassembled piles 6 onto the upper reach of an endless conveyor 25 forming part of the section 2 shown in FIG. 1*b*. The conveyor 25 has equidistant pushers 26 which intermittently entrain the piles 6 in the direction of arrow 30, namely into the range of one or more (e.g., three) knives 28 located at a subdividing station 27. The cutting edges of the knives 28 extend in the direction of the arrow 30 and serve to subdivide each reassembled pile 6 into discrete stacks 29 forming rows of aligned stacks which extend at right angles to the plane of FIG. 1*b*.

The rows of stacks 29 are transported beyond the subdividing or severing unit 27 including the knives 28 and into the apparatus which is constructed and assembled in accordance with the present invention. The heretofore described part of the production line (i.e., the structure shown in FIGS. 1*a* and 1*b*) is or can be identical with that described and shown in the aforementioned commonly owned copending patent application Ser. No. 10/396,705 of Ferdinand Fuchs for "APPARATUS FOR COUPLING STACKED SHEETS".

Figure 1B:
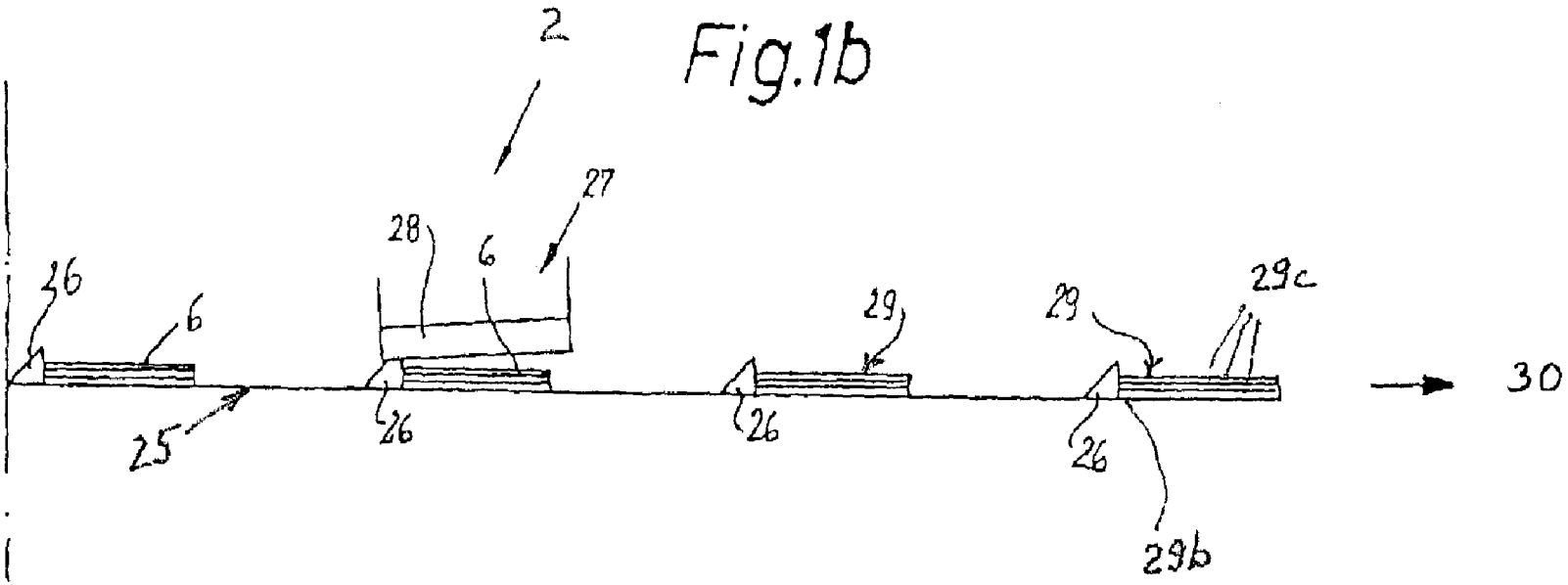
FIG. 1*b* is a similar schematic side elevational view of another portion of the stack assembling arrangement.

The apparatus which is shown in FIGS. 2 to 7 of the present application is designed to introduce discrete connectors 42 into the holes 29*a* in the spines 29*b* of discrete stacks 29 of overlapping sheets 29*c*. FIGS. 2 to 7 show apparatus for assembling a single connector 42 with a single stack 29 of sheets 29*c*. Thus, and since FIG. 1*b* shows a subdividing unit 27 with at least one knife 28, the plural stacks 29 which are obtained at 27 must be converted into a single file of successive discrete stacks which are advanced into the apparatus of FIGS. 2 to 7, or the conveyor 25 must feed groups of two or more stacks 29 to two or more apparatus of the type about to be described with reference to FIGS. 2 to 7. It is now assumed that the rows of stacks 29 produced by the severing unit 27 are converted into a single file and that successive discrete stacks 29 of the single file are fed into the apparatus of FIGS. 2 to 7.

The apparatus of FIGS. 2 to 7 comprises a unit 36 which serves to insert the (first) prongs 42*a* of successive elongated connectors 42 into the holes 29*a* in the spines 29*b* of successive stacks 29 of sheets 29*c* at the inserting station, and a unit 38 which thereupon deforms the connectors 42 by pivoting at least one of the two rows of prongs 42*a*, 42*b* relative to the other row and to thus ensure that the connectors 42 are reliably coupled to the respective stacks. The means for properly positioning successive discrete stacks 29 at the inserting station accommodating the unit 36 can include the pushers 26 and/or tongs of the type shown at 24 and/or other suitable locating means.

The unit 36 includes or cooperates with a unit 40 which serves to convey successive connectors 42 of a series of such connectors longitudinally of their respective bridges 42*c* to the inserting station accommodating the inserting unit 36.

Figure 2:
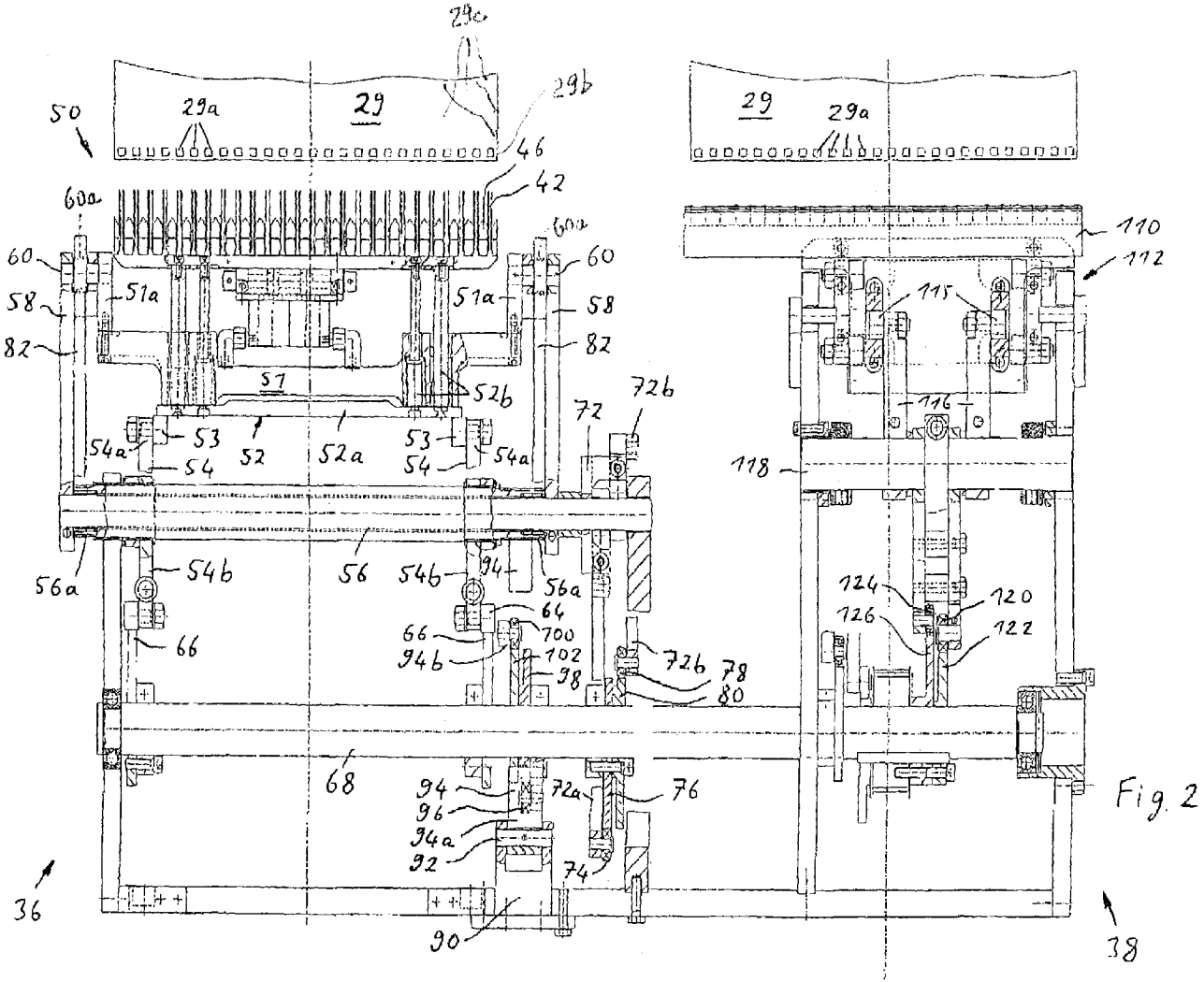
FIG. 2 is a partly elevational and partly sectional view of an apparatus which embodies one presently preferred form of the invention and serves (a) to couple successive connectors with discrete stacks of overlapping sheets at an inserting station, and (b) to thereupon non-separably secure the connectors to the respective stacks.

The illustrated conveying unit 40 includes two endless belt, band or chain conveyors 40*a*, 40*b* (see FIGS. 3 to 6) which deliver open (undeformed) connectors 42, namely connectors wherein the free (second) ends 42A, 42B of the respective C-shaped prongs 42*a*, 42*b* are spaced apart from each other so that the free ends 42A can be introduced into the respective holes 29*a* in response to the manipulation of each connector 42 in accordance with the method and in the apparatus of the present invention. The unit (36) for inserting the prongs 42*a* of successive connectors 42 into the holes 29*a* of the corresponding stacks 29 is shown in FIGS. 2 to 6, and the means (38) for closing (deforming) properly inserted connectors 42 is shown in FIGS. 2 and 7.

The discrete connectors 42 which are advanced lengthwise by the conveyors 40*a*, 40*b* of the transporting or conveying unit 40 are drawn from a maker (not shown) which is preferably designed to turn out a continuous connector and cooperates with a device which serves to subdivide the continuous connector into discrete connectors 42 of requisite length. Successive discrete connectors 42 being delivered to the unit 36 are caused to advance at right angles to the plane of FIG. 3. The number of prongs 42*a* and 42*b* on each connector 42 can but need not exactly match the number of holes 29*a* in a stack 29; for example, the arrangement can be such that each second hole 29*a* of a stack 29 receives a prong 42*a* and a prong 42*b* when the assembling and connector closing steps are completed.

Figure 3:
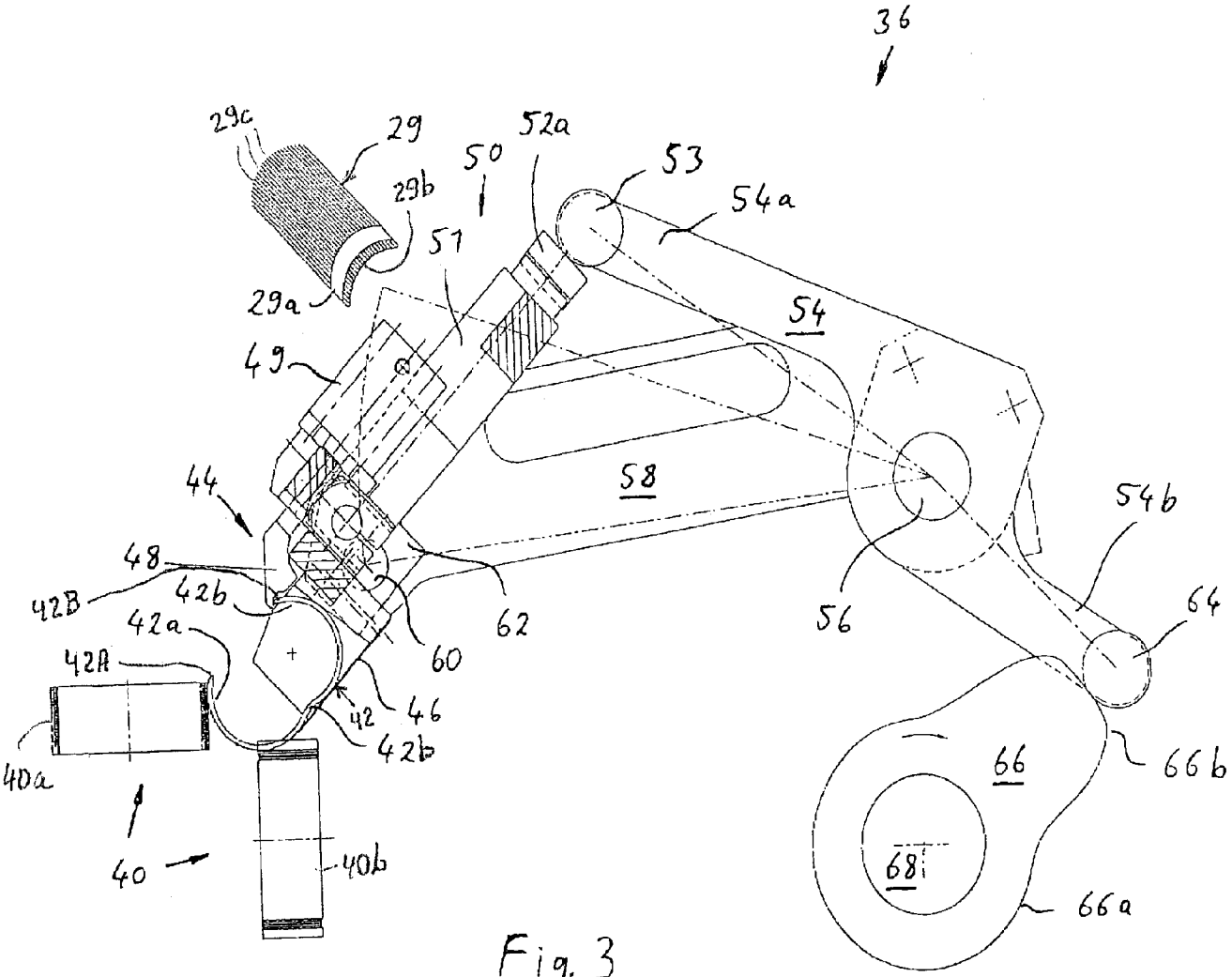
FIG. 3 is an enlarged fragmentary partly side elevational and partly sectional view of certain parts of the inserting unit shown in the left-hand portion of FIG. 2, a still open connector being illustrated in a position it assumes upon arrival at the inserting station.

FIG. 3 shows a still open deformable connector 42 at the station for the inserting unit 36 prior to introduction of free ends or tips 42A of its C-shaped (substantially semicircular) prongs 42*a* into the holes 29*a* of the stack 29. Each such hole has an arcuate shape which can be imparted thereto by apparatus of the type disclosed in the aforementioned copending patent application Ser. No. 10/400,065 of Ferdinand Fuchs for "METHOD OF AND APPARATUS FOR GATHERING STACKS OF SHEETS AND THE LIKE".

The conveyors 40*a*, 40*b* of the transporting unit 40 shown in FIG. 3 have completed the delivery of a connector 42 into the range of a clamping device 44 which forms part of the means for moving the prongs 42*a* of successive connectors 42 along an arcuate path extending transversely of the straight path defined by the conveyors 40*a*, 40*b* and being arranged to introduce the prongs 42*a* of a connector 40 at the unit 36 into the holes 29*a* of the stack 29 then occupying the station for the unit 36. The clamping device 44 includes a stationary (fixed) first or lower jaw 46 and a mobile second (upper) jaw 48. The connector 42 (and more specifically the row of prongs 42*a* of this connector) is borne by the stationary lower jaw 46, and at least the free end portions 42B of the other row of prongs 42*b* are engaged by the mobile jaw 48. The latter is movable by a pneumatically operated motor 49 which is started and arrested by a control unit (not shown) to selectively open or close the clamping device 44.

The clamping device 44 and the motor 49 form part of a clamping assembly or unit 50 further having a body 51 movably mounting a pusher 52 (see FIG. 2). The latter includes an exposed front end portion 52*a* and pairs of parallel mobile rods 52*b* slidable in bores (shown but not referenced in FIG. 2) provided therefor in the body 51. Those end portions of the rods 52*b* which are remote from the pusher 52 carry the clamping device 44 and the pneumatic motor 49. When the pusher 52 is caused to slide relative to the body 51 of the clamping assembly 50, the clamping device 44 is caused to change its position relative to the parts 50 and 51.

The elongated front end portion 52*a* of the pusher 52 is connected with two spaced-apart hinges 53 (see FIG. 2) borne by the adjacent first end portions 54*a* of two levers 54 pivotably mounted on a first elongated shaft 56. The latter is fixedly connected with the adjacent first end portions of two arms 58 the second end portions of which support second shafts 60. These second shafts pivotably support the spaced-apart extensions 51*a* of the body 51 of the clamping assembly 50. This can be seen in FIG. 3 but particularly in FIG. 2.

The other (second) end portions 54*b* of the levers 54 carry roller followers 64 serving to track the peripheral surfaces of two disc cams 66 mounted on a turnable camshaft 68. Suitable motor means (not shown) is provided to turn the camshaft 68 in synchronism with the movements of other mobile parts of the connector inserting unit 36 and of the connector closing (deforming) unit 38. The camshaft 68 is parallel to the aforementioned shafts 60 (which are coaxial with each other) and to the first shaft 56.

FIG. 3 shows that the disc cam 66 has a substantially pear-shaped outline with a first convex cam face 66*b* and a second convex cam face 66*a*. The throw of the lobe which carries the cam face 66*b* is greater than the throw of that part of the cam 66 which carries the cam face 66*a*. When the cam 66 is caused to rotate with the camshaft 68, the follower 64 causes the lever 54 to perform rocking movements about the axis of the shaft 56 with the result that the clamping device 44 moves toward and away from the transporting unit 40. In FIG. 3, the device 44 is located at a minimum distance from the transporting unit 40 and is in a position to engage and entrain a connector 42 which has been delivered to the inserting station by the conveyors 40*a*, 40*b* of the unit 40. The device 44 is held in such position because the follower 64 tracks the cam face 66*b* of the lobe which forms part of the disc cam 66. The inserting unit 36 further includes means (such as one or more coil springs, leaf springs, a pneumatically operated piston and/or the like—not shown) for biasing the lever 54 in a clockwise direction (as viewed in FIG. 3) so that the roller follower 64 is urged against and is in continuous contact with the face 66*a* or 66*b* of the disc cam 66.

As the camshaft 68 continues to turn about its axis, the roller follower 64 bears upon the face 66*a* of the disc cam 66 which results in a pronounced change of angular position of the lever 54, i.e., the follower 64 moves much closer to the axis of the shaft 68. Thus, the pusher 52 is caused to move away from the transporting unit 40 and causes the unit 44 to entrain the connector 42 (which was delivered by the conveyors 40*a*, 40*b*) toward the stack 29. This ensures that the unit 40 can be set in motion in order to deliver a fresh connector 42 from the maker into the range of the jaws 46, 48 of the clamping device 44.

Figure 4:
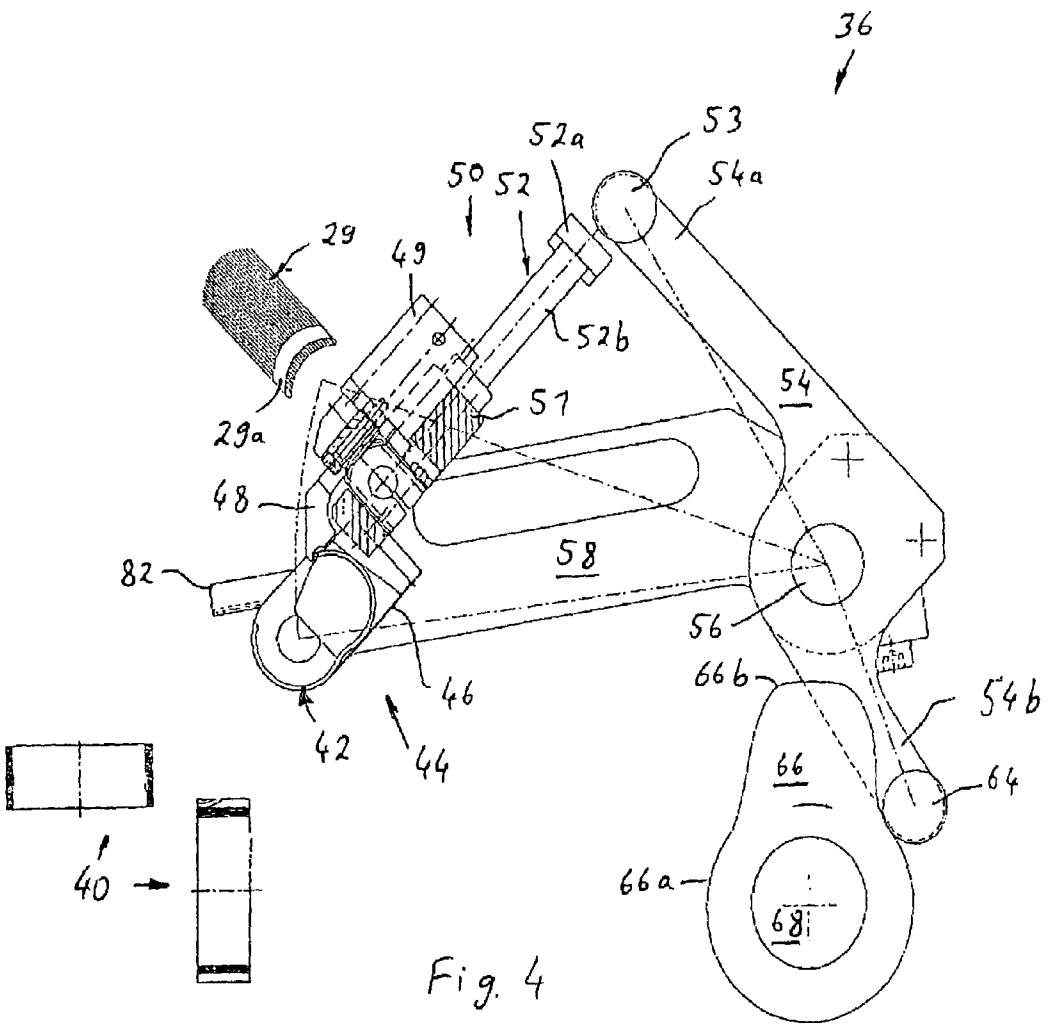
FIG. 4 illustrates the structure of FIG. 3 but with the still open connector nearer to the stack at the inserting station.

The next position of the still open connector 42 which was removed from the conveyors 40*a*, 40*b* is shown in FIG. 4. The position of the arm 58 (relative to the unit 40 and stack 29) during such transport of a connector 42 from the position of FIG. 3 to that which is shown in FIG. 4 remains unchanged.

Figure 5:
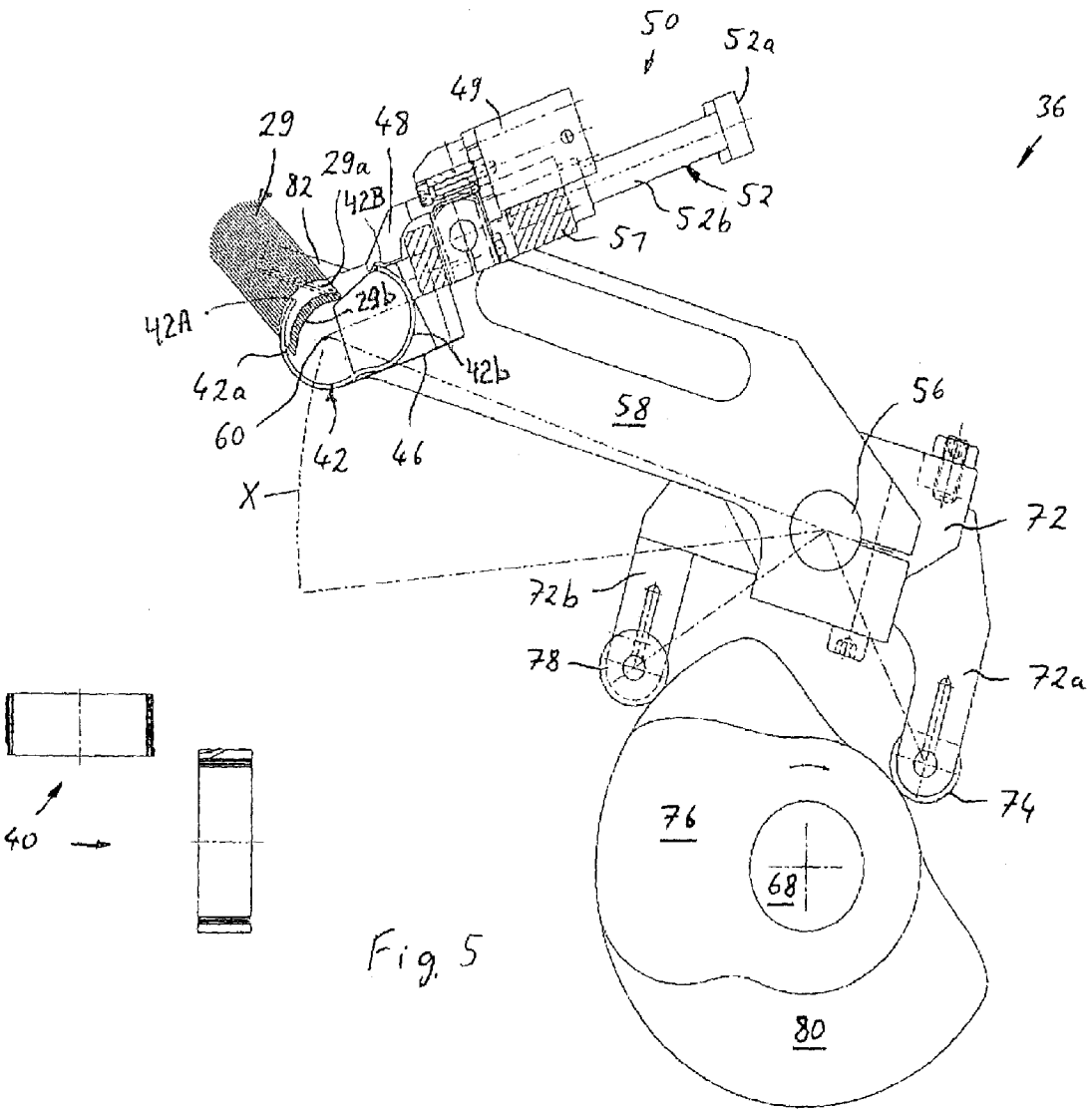
FIG. 5 shows the structure of FIG. 4 but with the connector partly coupled to the stack at the inserting station.

FIG. 5 shows that the first shaft 56 non-rotatably carries a second lever 72 having a first arm 72*a* and a second arm 72*b*. The arm 72*a* carries a roller follower 74 arranged to track the peripheral surface of a disc cam 76, and the arm 72*b* carries a roller follower 78 which tracks the peripheral surface of a disc cam 80 (see also FIG. 2). The cams 76, 80 are non-rotatably mounted on the camshaft 68. Suitable biasing means (not shown), such as one or more coil springs, leaf springs and/or pneumatic cylinder and piston units, are provided to maintain the roller followers 74, 78 in contact with the respective cams 76, 80.

When the camshaft 68 is caused to rotate the cams 76 and 80, the two-armed lever 72 is caused to rock back and forth about the axis of the shaft 56 and the latter rocks the arm 58. This causes the entire clamping assembly 50 to move away from the transporting unit 40 and to entrain the still open connector 42 which is held by the jaws 46, 48 of the clamping device 44. The connector 42 moves along an arcuate path and causes the free ends 42A of its prongs 42*a* to enter the adjacent ends of the respective holes 29*a* in the spine 29*b* of the stack 29 being held at the inserting station (see FIG. 5). The arcuate path of movement of a connector 42 from the position of FIG. 4 to that which is shown in FIG. 5 in indicated in FIG. 5 by a dot-dash line X. The distance between the axis of the shaft 56 and the common axis of the shafts 60 is selected in such a way that the prongs 42*a* are properly oriented relative to and that their free ends 42A can readily enter the confronting open ends of the holes 29*a* in the spine 29*b* of the then stationary stack 29.

During the just described movement of the connector 42 along the arcuate path X from the position of FIG. 4 to that which is shown in FIG. 5, the position of the connector relative to the body 51 of the clamping assembly 50 remains unchanged, i.e., the body 51 shares such movement of the connector with the arm 58.

As already described with reference to FIG. 3, and as also shown in FIG. 2, the body 51 of the clamping assembly 50 is pivotable relative to the arms 58 because its end portions 51*a* are pivotably coupled to the respective arms 58 by the shafts 60. The extent of pivotal movement of the body 51 relative to the arms 58 is determined by toothed racks 82 which are carried by the arms 58 and have teeth (not specifically shown) mating with the teeth of gears 60*a* borne by or provided on the respective shafts 60. When the toothed racks 82 move lengthwise, the body 51 of the clamping assembly 50 is caused to move along an arcuate path because the shafts 60 (and hence the gears 60*a*) are non-rotatably affixed to the respective lateral supporting arms 51*a* of the body 51. The shafts 60 are rotatable in the respective arms 58.

Figure 6:
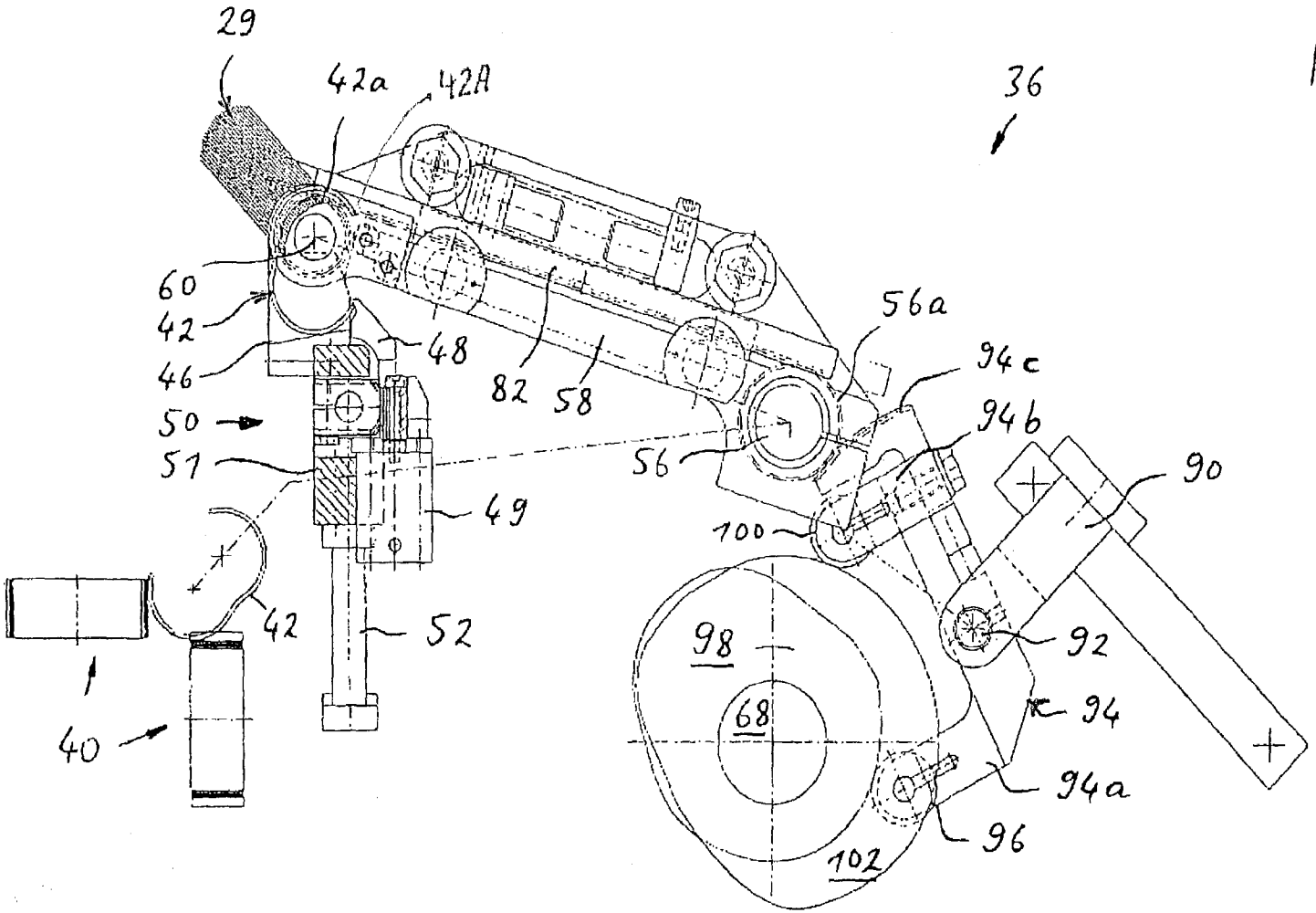
FIG. 6 illustrates the structure of FIG. 5 but with one set of prongs of the connector in or close to its final position relative to the stack.
Figure 7:
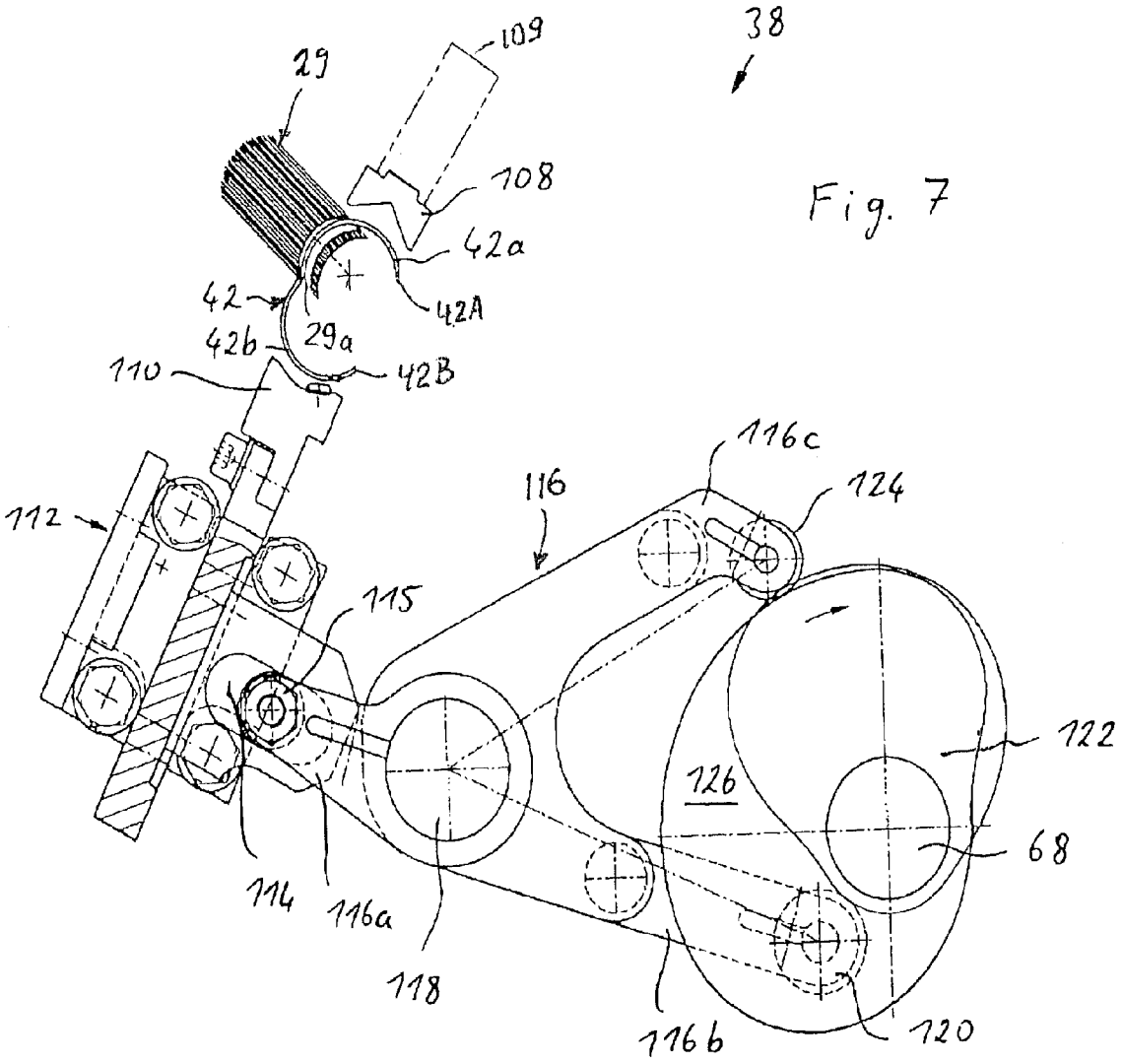
FIG. 7 is a partly side elevational view and partly sectional view of that unit in the apparatus of FIG. 2 which serves to deform the connector of FIG. 6 so that it is at least substantially non-separably affixed to the stack.

The end portions of the shaft 56 carry or are provided with portions of or with entire gears 56*a* each of which can mate with the respective one of the two toothed racks 82 (see FIGS. 2 and 6). It will be noted that FIG. 6 shows certain details of one of the arms 58 and of one of the toothed racks 82 which are omitted in FIGS. 3 to 5 for the sake of clarity.

FIG. 6 further shows a stationary holder 90 (see also FIG. 2) for a universal joint (Cardan shaft) 92 which serves to movably connect the holder 90 with a pivotable third two-armed lever 94. The latter comprises two parallel or substantially parallel arms 94*a* and 94*b*. The arm 94*a* carries a roller follower 96 which tracks the peripheral surface of a disc cam 98 non-rotatably mounted on the camshaft 68, and the arm 94*b* (which is adjacent one of the arms 58) carries a roller follower 100 which tracks the peripheral surface of a further disc cam 102 non-rotatably affixed to the camshaft 68. Again, the improved apparatus comprises means for permanently biasing the roller followers 96, 100 against the peripheral surfaces of the respective disc cams 98, 102.

The arm 94*b* of the third two-armed lever 94 is adjacent a marginal portion of this lever, and such marginal portion is provided with a slightly arcuate gear segment 94*c* (see FIG. 6) which mates with one of the two gears 56*a* on the shaft 56. The curvature of the toothed gear segment 94*c* is that of a circle having its center on the axis of the universal joint 92.

When the disc cams 98 and 102 are caused to rotate, they bring about a rocking movement of the two-armed lever 94 about the axis of the universal joint 92. This entails a reciprocatory movement of the gear segment 94*c* which, in turn, causes reciprocatory movements of the toothed racks 82. These racks transmit motion to the respective shafts 60 which, in turn, impart rocking motion to the clamping assembly 50.

The configurations of the disc cams 98 and 102 are such that, when the clamping assembly 50 assumes the positions shown in FIGS. 3, 4 and 5, this assembly is held against angular movement about the axes of the shafts 60 and relative to the arms 58. Such angular movement takes place in order to advance the clamping assembly 50 from the position of FIG. 5 to that (operative) position which is shown in FIG. 6. This takes place because the toothed racks 82 are then caused to move lengthwise and to thus cause the clamping assembly 50 to move relative to the arms 58, about the axes of the shafts 60, and to the position of FIG. 6. During such pivotal movement of the clamping assembly 50, the center of curvature of the row of arcuate prongs 42*a* of the connector 42 being held by the jaws 46, 48 of the clamping unit 44 is located on or at least close to the common axis of the shafts 60. This entails that, during movement of the clamping assembly 50, the connector 42 and its row of arcuate prongs 42*a* are caused to travel about an axis such that the tips 42A of the prongs 42*a* are free to enter the respective ends of the holes 29*a* in the spine 29*b* of the stack 29 at the inserting station. FIG. 6 shows that the free ends 42A of the prongs 42*a* can advance into, through and even beyond (i.e., again out of) the respective holes 29*a*.

The next step involves an actuation of the pneumatic drive 49 to displace the section 48 of the clamping unit 44 so that the assembly 50 is disengaged from the connector 42. The position of this connector relative to the stack 29 at the inserting station remains unchanged because the prongs 42*a* extend through the respective holes 29*a* in the spine 29*b*, i.e., the connector 42 remains suspended on the stack 29.

As the disc cams 98 and 102 continue to turn with the camshaft 68, the double-armed lever 94 continues to share such movement and the toothed racks 82 are caused to turn the shafts 60 in a direction to return the clamping assembly 50 to the position of FIG. 4. The lever 54 thereupon causes the pusher 52 (and hence the clamping unit 44) to move from the position of FIG. 4 back to the position of FIG. 3 so that the jaws 46, 48 can engage the prongs 42*b* of the next (open) connector 42 which, in the meantime, has been delivered to the inserting unit 36 by the conveyors 40*a*, 40*b* of the transporting unit 40.

As can be seen in FIG. 6, the illustrated inserting unit 36 serves solely to cause the prongs 42*a* of an open connector 42 to enter the holes 29*a* of the stack 29 at the inserting station determined by the position of the stack which was supplied in the direction of arrow 30 shown in FIG. 1*b*. The clamping assembly 50 of the unit 36 serves to grip successive oncoming open connectors 42 (supplied by the transporting unit 40) as well as to change the orientation of such open connectors and to thus introduce their prongs 42*a* into the registering holes 29*a* of successive stacks 29 at the inserting station.

One presently preferred embodiment of the connector closing means is shown, at 38, in FIGS. 2 and 7. It is customary to install the closing means 38 adjacent the inserting unit 36. As shown in FIG. 2, the arrangement can be such that it is merely necessary to move a stack 29, with a still open connector 42 suspended on the stack, in the longitudinal direction of the row of holes 29*a*, i.e., lengthwise of the suspended connector. The extent of such movement should suffice to ensure that a fresh stack 29 can be delivered to the inserting station shown at the top of the left-hand portion of FIG. 2. The orientation of the still open or partly open connector 42 which has been assembled (at 36) with a stack 29 need not be changed during transfer from the unit 36 into the unit 38.

In FIG. 7, the unit 38 is shown in a side elevational view, i.e., in a view corresponding to that of the unit 36 of FIGS. 2 to 6, and drawn to a much larger scale than in the front elevational view in the right-hand portion of FIG. 2. The unit 38 comprises an upper beam-shaped closing or deforming member 108 which is mounted on a carrier or bearing (not shown) in such a way that it can be moved through a relatively short distance downwardly toward and upwardly away from a connector 42 at the closing station. Such movements of the member 108 are initiated by a drive 109 shown in FIG. 7 by dot-dash lines. The stroke of the member 108 should suffice to ensure that a connector 42 can be introduced, without interference, into the unit 38 when the member 108 assumes the retracted position shown in FIG. 7.

FIG. 7 further shows a second or lower deforming member 110 which is mounted on a slide or carriage 112. The latter is reciprocable in a sense to move the deforming member 110 toward and away from the connector 42 borne by the stack 29 at the connector closing station. The extent of movement of the second or lower deforming member 110 exceeds considerably that of the upper deforming member 108. The means for reciprocating the carriage 112 and hence the lower deforming member 110 between its end positions comprises a roller 115 which is received in an elongated slot 114 of the carriage. The roller 115 is mounted on or in a first arm 116*a* of a three-armed lever 116 which is pivotable relative to a shaft 118. A second arm 116b of the lever 116 carries a roller follower 120 which tracks the peripheral surface of a disc cam 122. A third arm 116*c* of the lever 116 is provided with a further roller follower 124 which is caused to track the peripheral surface of a further disc cam 126.

The disc cams 122 and 126 are mounted on and are rotatable by (because they are non-rotatably affixed to) the camshaft 68 of the connector inserting unit 36. Thus, these disc cams rotate with the other cams 76, 80, etc. when the shaft 68 is set in rotary motion. The roller followers 120, 124 are maintained in uninterrupted contact with the peripheral surfaces of the respective cams 122, 126.

When the cams 122, 126 are caused to rotate with the shaft 68, the three-armed lever 116 (and hence its arm 116*a*) is caused to perform rocking (back-and-forth) movements which entails corresponding reciprocatory movements of the carriage 112 and hence of the lower deforming member or beam 110. Once a stack 29 (and the still open connector 42 which is appended thereto) has entered the connector closing unit 38, the upper deforming member 108 is lowered to such an extent that it reaches and abuts the prongs 42*a* of the just mentioned connector. At the same time, or subsequent to such downward movement of the deforming member 108, the cam 68 is set in rotary motion to change the angular positions of the disc cams 122, 126 through angles which are necessary to pivot the three-armed lever 116 to an extent that is required to move the carriage 112 and the deforming member 110 thereon in a direction toward the connector 42 borne by the stack 29. This causes the lower prongs 42*b* of the up-to-then still open connector 42 to undergo requisite deformation or displacement relative to the prongs 42*a* which then abut the deforming member 108. The end result is that the free ends 42A of the prongs 42*a* abut or overlap the free ends 42B of the prongs 42*b*. It will be seen that the member 108 serves as an anvil which holds the adjacent prongs 42*a* against movement while the prongs 42*b* move upwardly toward the prongs 42*a*.

It is also within the purview of the present invention to provide the connector closing unit 38 with a suitable back support (not shown in FIGS. 2 and 7) which can serve as an abutment for (e.g., for the bridge 42*c* of) the connector 42 so that the latter is even more reliably held in an optimum position while the deforming members 108, 110 respectively engage and displace the prongs 42*a*, 42*b* of the connector 42 which is borne by the stack 29 then held in the unit 38. Such back support can be mounted for pivotal movement between its operative and retracted positions.

Once the step of deforming at least the prongs 42*b* of the connector 42 in the unit 38 is completed, the deforming member 110 is returned to the retracted position of FIG. 7 (and, if necessary, the drive 109 returns the deforming member 108 to the position of FIG. 7) before a suitable conveyor (not shown) removes the stack 29 and its finished connector 42 from the unit 38, e.g., to storage or to a packing or stacking station, not shown.

The arcuate path A, along which a connector 42 at the inserting station accommodating the unit 36 moves, extends transversely of the bridge 29*b* of the connector being held by the device 44 of the clamping assembly 50; the curvature of such arcuate path can at least approximate the curvature of a prong 42*a* or the curvatures of the holes 29*a*. As already mentioned hereinbefore, the holes 29*a* can be caused to assume arcuate shapes in a manner as fully disclosed in the commonly owned copending patent application Ser. No. 10/400,065 of Ferdinand Fuchs for "METHOD OF AND APPARATUS FOR GATHERING STACKS OF SHEETS AND THE LIKE". The apparatus of Ferdinand Fuchs can be installed between the conveyor 25 of FIG. 1*a* and the inserting unit 36 of FIGS. 2 to 6.

If the prongs 29*a* are partly circular prongs (e.g., extending along arcs of about 180°), the connector 42 at the inserting station for the unit 36 can be turned about an axis including the centers of curvature of the row of prongs 42*a* forming part of the connector which occupies the inserting station. Alternatively, the connector 42 at the inserting station can be moved along an arcuate path having its center of curvature on an axis including the centers of curvature of arcuate holes 29*a* in the spine 29*b* of the stack 29 at such station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of pivotably coupling stacked sheet-like commodities with each other and, therefore, such adaptations should and are intended to be comprehended within the meaning and range of equivalence of the appended claims.

What is claimed is:

1. Apparatus for applying to stacks of overlapping sheets connectors having an elongated bridge carrying two at least substantially mirror symmetrical rows of curved prongs receivable in holes provided in one of several marginal portions of the stacks, comprising:

means for positioning successive stacks of a series of stacks at an inserting station;

means for conveying successive connectors of a series of connectors to said station in positions such that the prongs of at least one of the two rows of prongs forming part of the connector are aligned with the holes of the stacks at said station; and means for introducing at least the prongs of said at least one row into the holes of the stack at said station, including means for moving the connector at said station along an arcuate path extending transversely of the bridge of such connector and at least approximating at least one of (a) the curvature of the prongs in said at least one row and (b) the shapes of the holes in the stack at said station.

2. The apparatus of claim 1, wherein the connectors are made at least in part of a bendable metallic material.

3. The apparatus of claim 1, wherein said moving means includes means for moving the connector at said station along said path until the prongs of the at least one row extend at least substantially through the respective holes of the stack at said station.

4. The apparatus of claim 1 for applying connectors wherein the prongs of each row have first ends of one piece with the bridge and second ends, with the second ends of one row of prongs spaced apart from the second ends of prongs in the other row, further comprising means for deforming the prongs of at least one row of prongs of the connector to move the second ends of the prongs of said at least one row close to the second ends of prongs of the other row.

5. The apparatus of claim 1 for applying connectors wherein the prongs of each of the two rows have shapes at least approximating part circular shapes, wherein said arcuate path has a center of curvature on a line including the centers of curvature of said one row of prongs.

6. The apparatus of claim 1, further comprising means for removing stacks from said station and means for engaging the connectors to the respective stacks upon removal of stacks from said station.

7. The apparatus of claim 1, wherein said conveying means includes means for supplying the connectors of the series of connectors into the range of said engaging means by moving the connectors lengthwise of the respective bridges.

8. The apparatus of claim 7, wherein said conveying means is arranged to advance connectors of the series along a second path and said engaging means includes means for moving successive connectors at least substantially transversely of said second path.

9. The apparatus of claim 8, wherein said engaging means includes a first section and a second section movable relative to said first section.

10. A method of applying to stacks of overlapping sheets deformable connectors having an elongated bridge carrying two at least substantially mirror symmetrical rows of curved prongs receivable in holes provided in one of several marginal portions of the stacks, the prongs of said rows having first ends affixed to the bridge and second ends with the second ends of prongs in one of the rows spaced apart from the second ends of prongs in the other row prior to the application of connectors to the stacks, comprising the steps of:

positioning successive stacks of a series of stacks at an inserting station;

conveying successive connectors of a series of connectors to said station and positioning a connector arriving at the station in such a way that the second ends of prongs of the one row are aligned with the holes of the stack at said station; and introducing the prongs of the one row into the holes of the stack at said station, including moving the connector at said station to advance the prongs of the one row along arcuate paths having curvatures at least approximating at least one of (a) the curvatures of the moving prongs and (b) the shapes of holes in the stack at said station.

11. The method of claim 10, wherein the prongs have part circular shapes and said moving step includes turning the connector at said station about an axis including the centers of curvature of one of the rows of prongs of the connector at said station.

12. The method of claim 11, wherein said turning step includes holding the connector at said station by a mobile engaging device.

13. The method of claim 10, wherein said conveying step includes advancing successive connectors of said series of connectors along a second path extending lengthwise of the bridges of the advancing connectors.

14. The method of claim 13, wherein said conveying step further includes moving successive connectors transversely of their bridges upon arrival at said station and prior to said introducing step.

15. The method of claim 10, further comprising the step of deforming successive connectors upon completion of said introducing step to thus prevent withdrawal of prongs of the one row from the respective holes.

16. The method of claim 15, wherein said deforming step includes moving the second ends of said rows of prongs of the connector at said station toward each other.

17. The method of claim 16, further comprising the step of removing the stacks from said station upon completion of one of said introducing and deforming steps.

18. The method of claim 10 of applying to stacks deformable connectors consisting at least in part of a metallic material, further comprising the steps of assembling sheets into stacks prior to said positioning step and perforating the sheets prior to said assembling step in such a way that the perforations of stacked sheets are in at least substantial alignment with each other and form said holes.

* * * * *